United States Patent [19]

Löbbe

[11] 4,154,480

[45] May 15, 1979

[54] MINERAL MINING INSTALLATION

[75] Inventor: Armin Löbbe, Lunen, Fed. Rep. of Germany

[73] Assignee: Gewerkschaft Eisenhutte Westfalia, Lunen, Fed. Rep. of Germany

[21] Appl. No.: 878,646

[22] Filed: Feb. 17, 1978

[30] Foreign Application Priority Data

Feb. 23, 1977 [DE] Fed. Rep. of Germany ..... 2707723

[51] Int. Cl.[2] ..... E21C 27/18; E21C 29/00

[52] U.S. Cl. ..... 299/34; 299/43; 299/54

[58] Field of Search ..... 299/34, 43, 54, 53

[56] References Cited

U.S. PATENT DOCUMENTS

| | | | |
|---|---|---|---|
| 3,306,663 | 2/1967 | Webster | 299/54 |
| 3,356,417 | 12/1967 | Heyer et al. | 299/71 |
| 3,907,367 | 9/1975 | Nakojima | 299/86 |
| 4,082,361 | 4/1978 | Lantermann | 299/43 |

FOREIGN PATENT DOCUMENTS

| | | | |
|---|---|---|---|
| 1099546 | 1/1968 | United Kingdom | 299/34 |
| 1143748 | 2/1969 | United Kingdom | 299/43 |
| 1403821 | 8/1975 | United Kingdom | 299/43 |

*Primary Examiner*—William Pate, III

*Attorney, Agent, or Firm*—Sughrue, Rothwell, Mion, Zinn and Macpeak

[57] ABSTRACT

A mineral mining installation has a conveyor and a plough movable along a guide provided at the face side of the conveyor. An auxiliary winning machine constituted by a cutter drum mounted on a carrier by means of a pivotal jib, is provided for winning material in the "stable-hole" region. The carrier is movable along an auxiliary guide which is an extension of the plough guide. The carrier is provided with a drivable pinion which meshes with a rack on the auxiliary guide for driving the auxiliary winning machine along the auxiliary guide.

14 Claims, 4 Drawing Figures

MINERAL MINING INSTALLATION

BACKGROUND OF THE INVENTION

This invention relates to a mineral mining installation, and in particular to an installation for winning material in the "stable-hole" region at the end of a longwall face.

Winning of coal from a longwall face adjoining a roadway or gallery has always been difficult, since the known type of coal plough, which is guided on a longwall conveyor, can only remove coal between the two end drive stations of the conveyor. The portions of the longwall face that accommodate the drive stations (that is to say the so-called "stable-hole" regions) must, therefore, either be won by hand or by auxiliary winning machines. Unfortunately, known auxiliary winning machines are both costly and bulky.

As an alternative to providing auxiliary winning machines for winning the "stable-hole" regions, the longwall conveyor can be extended into the access roads at the two ends of the longwall face, so that the plough can win coal along the entire length of the longwall face. The disadvantage of this arrangement is that the heavy and bulky drive units for the plough and the conveyor are accommodated in the access roads themselves, which is obviously undesirable.

The aim of the invention is to produce a mineral mining installation incorporating a comparatively simple and light auxiliary winning machine for winning material in a "stable-hole" region.

SUMMARY OF THE INVENTION

The present invention provides a mineral mining installation comprising a conveyor, a main winning machine movable along a main guide provided at the face side of the conveyor, and an auxiliary winning machine for winning material from the "stable-hole" at one end of the conveyor, the auxiliary winning machine being movable along an auxiliary guide, wherein the auxiliary winning machine is provided with a drivable pinion which drivingly engages a rack provided on the auxiliary guide for driving the auxiliary winning machine along the auxiliary guide.

The provision of this rack-and-pinion drive for the auxiliary winning machine reduces the overall weight and size of the anuxiliary winning machine as compared with the known types of auxiliary winning machines.

Preferably, the auxiliary guide is constituted by an extension of the main guide, and the auxiliary guide has the same form as the main guide so that the main plough is movable at least partly along the auxiliary guide. The operating range of the main winning machine can, therefore, overlap that of the auxiliary winning machine.

Advantageously, the main winning machine is a plough which is driven by an endless chain passing round two sprockets at the ends of the conveyor. In this case, it is preferable for the auxiliary guide to extend beyond the adjacent end sprocket.

The rack may be provided on the top of the auxiliary guide. Advantageously a row of equispaced cut-outs in the auxiliary guide constitutes the rack. In this case, the pionion may be constituted by a pinwheel.

Preferably, the main guide is constituted by an inclined guide surface and a pair of channels for the two runs of the plough drive chain.

Preferably, the auxiliary winning machine is constituted by a cutter drum mounted on a jib which is mounted for pivotal movement in a vertical plane on a carrier which is movable along the rack. By arranging for the jib to swing through 180°, the cutter drum can be moved along an arc corresponding to that of the profile of the access road. Consequently, the auxiliary winning machine can also be used to excavate the road. This may be facilitated by arranging that at least part of the auxiliary guide is pivotally movable in a vertical plane, and that the jib is telescopically extensible.

Small hydraulic motors may be provided for driving both the pinion and the cutter drum. The hydraulic supply lines for these motors can easily be accommodated in the adjacent road.

The invention also provides an auxiliary winning machine for use with the mineral mining installation defined above, the auxiliary winning machine being movable along an auxiliary guide, wherein the auxiliary winning machine is constituted by a cutter drum mounted on a carrier by means of a jib, and wherein the carrier is provided with a drivable pinion which drivingly engages a rack provided on the auxiliary guide for driving the auxiliary winning machine along the auxiliary guide.

BRIEF DESCRIPTION OF THE DRAWINGS

A mineral mining installation constructed in accordance with the invention will now be described, by way of example, with reference to the accompanying drawings, in which.

DESCRIPTION OF PREFERRED EMBODIMENT

Figure 1:
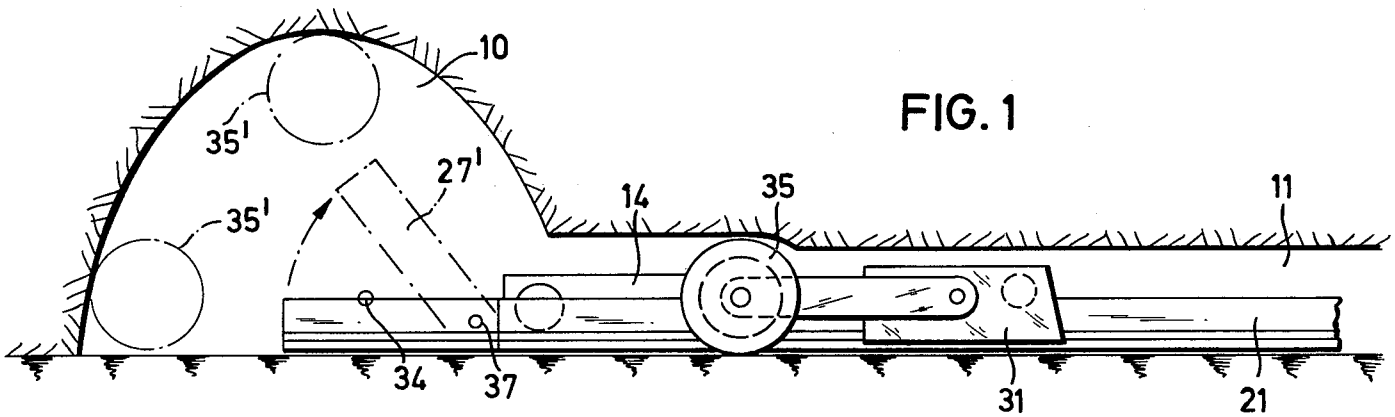
FIG. 1 is a side elevation of the installation showing the region between a longwall working and an access road.
Figure 2:
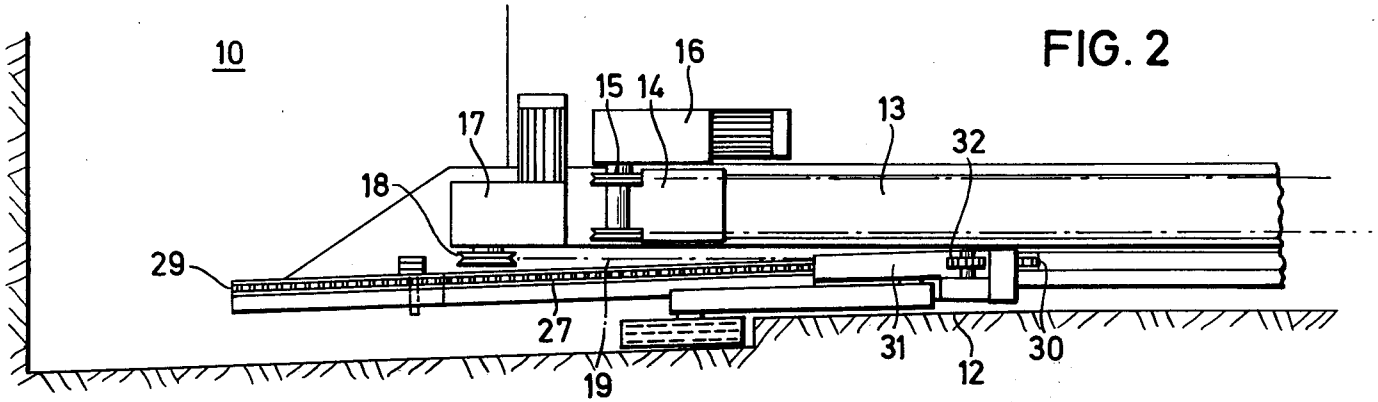
FIG. 2 is a plan view of the installation of FIG. 1.
Figure 3:
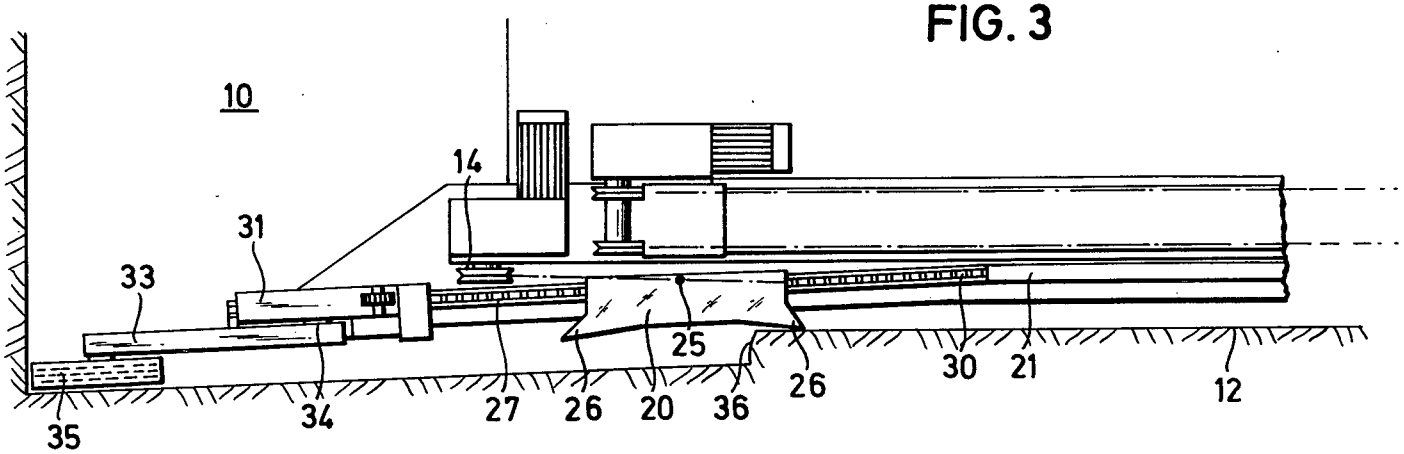
FIG. 3 is a plan view similar to FIG. 2, but showing a different operating state.
Figure 4:
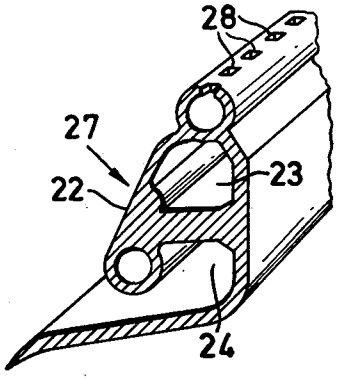
FIG. 4 is a perspective view of a section of the guide for the auxiliary winning machine of the installation.

Referring to the drawings, FIGS. 1 to 3 show a mine working having a top road 10 and a longwall working 11 having a longwall face 12 (see FIGS. 2 and 3). A scraper-chain conveyor 13 is positioned in the longwall working 11 adjacent to the longwall face 12. As is usual the scraper-chain conveyor 13 is constituted by a plurality of individual channel sections joined end-to-end in such a manner as to permit a limited degree of articulation between adjacent channel sections. As is conventional, a drive station is provided at each end of the conveyor 13, only one of these stations (the auxiliary drive station) being shown in the drawings. A chain drum 15 for driving the conveyor 13 is mounted within a drive frame 14 of the auxiliary drive station, the chain drum being positioned adjacent to the top road 10. A drive unit 16 for driving the conveyor 13 via the chain drum 15 is flanged to the goaf-side side plate of the drive frame 14. A drive unit 17 is mounted on the end of the drive frame 14, this drive unit 17 serving to drive a longwall plough 20 via a drive chain 19 and two end sprockets (only one of which, sprocket 18, can be seen in the drawings). The end sprocket 18 is, therefore, positioned well beyond the end of the drive frame 14.

The face-side of the conveyor 13 is provided with a guide 21 for the plough 20. The guide 21 is constituted by a plurality of guide sections which correspond to the channel sections forming the conveyor 13, and which are articulated together. Each guide section has an inclined guide plate 22 which defines a pair of channels 23 and 24 for the two runs of the plough drive chain 19.

The plough drive chain 19 is fastened to the plough 20 at 25 (see FIG. 3), that is to say substantially centrally of the plough body. Consequently, the plough 20 may be driven in either direction and its cutters 26 will cut coal relatively well ahead of the point 25 of connection between the plough and its drive chain 19. Indeed, as can be seen in FIG. 3, coal can be won by the plough 20 right up to the drive frame 14, the guide 21 being extended alongside the drive frame and out into the road 10.

At the end of the longwall working 11, the guide 21 is provided with a rack 27 constituted a series of equispaced holes 28 formed in the top of the guide. The rack 27 extends from the free end 29 of the guide 21 up to a point 30 situated some distance along the longwall working 11 from the drive frame 14. The plough 20 can, therefore, travel along part of the portion of the guide 21 provided with the rack 27.

An auxiliary winning machine is provided for winning coal in the "stable-hole" region at the end of the longwall working 11. This auxiliary winning machine is constituted by a carrier 31 which supports a cutter drum 35 via a jib 33 pivotally mounted on the carrier by means of a swivel bearing 34 having a horizontal swivel axis. The carrier 31 is driven to and fro along the rack 27 by means of a pinwheel 32 which drivingly engages the holes 28 of the rack. The pinwheel itself is powered by a small hydraulic motor (not shown). The cutter drum 35 is also powered by a small hydraulic motor (not shown).

The auxiliary winning machine is shown in its two extreme positiones in FIGS. 2 and 3, and it will be apparent that as this machine moves between these two positions the "stable-hole" region will be cut away by a depth corresponding to the width of the cutting drum 35. In practice, the cutting drum 35 is relatively thin, to cut to a depth say of about 2 to 5 times the depth of cut of the plough 20.

As can be seen in FIG. 1, the cutter drum 35 can be swung on its jib 33 through nearly 180° relative to the carrier 31. Two positions 35' of the cutter drum 35 are shown in FIG. 1 in dash-dot lines. The auxiliary winning machine can, mine away the entire road 10. In order to mine roads having different profiles, the jib 33 may be telescopically extensible. Moreover, in order to assist with the finishing off of the arc of the road profile, the end part of the guide 21 may be pivotable in a vertical plane about a pivot joint 37—as can be seen in dash-dot lines at 27' in FIG. 1. This end portion of the guide 21 could also be arranged to swing in a horizontal plane.

FIGS. 2 and 3 also show that part of the guide 21 provided with the rack 27 lies at a small acute angle to the rest of the guide, and is directed towards the longwall face 12. This leaves a free space between the rack 27 and the drive frame 14 for accommodation of the plough drive chain 19 as it approaches and leaves the sprocket 18.

The guide 21, auxiliary winning machine may be advanced jointly as a unit with the conveyor 13 and the associated drive units 16 and 17, as the longwall face 12 advances.

I claim:

1. A mineral mining installation comprising a conveyor, a main winning machine movable along a main guide provided at the face side of the conveyor, and an auxiliary winning machine for winning material from the "stable-hole" at one end of the conveyor, the main winning machine comprising a plough which is driven by an endless chain passing round two sprockets at the ends of the conveyor, the auxiliary winning machine being movable along an auxiliary guide extending beyond the end sprocket at said one end, wherein the auxiliary winning machine is provided with a drivable pinion which drivingly engages a rack provided on the auxiliary guide for driving the auxiliary winning machine along the auxiliary guide.

2. An installation according to claim 1, wherein the auxiliary guide is constituted by an extension of the main guide.

3. An installation according to claim 2, wherein the auxiliary guide has the same form as the main guide so that the main winning machine is movable at least partly along the auxiliary guide.

4. An installation according to claim 1, wherein the rack is provided on the top of the auxiliary guide.

5. An installation according to claim 1, wherein a row of equispaced cut-outs in the auxiliary guide constitutes the rack.

6. An installation according to claim 5, wherein the pinion is constituted by a pinwheel.

7. An installation according to claim 1, wherein the main guide is constituted by an inclined guide surface and a pair of channels for the two runs of the plough drive chain.

8. An installation according to claim 1, wherein at least part of the auxiliary guide is pivotally movable in a vertical plane.

9. An installation according to claim 1, wherein the auxiliary guide lies at an angle to the main guide and extends towards the working face.

10. An installation according to claim 1, wherein the auxiliary winning machine is constituted by a cutter drum.

11. An installation according to claim 10, wherein the cutter drum is such as to produce a cut whose depth is between two and five times the depth of cut produced by the main winning machine.

12. An installation according to claim 10, wherein the cutter drum is mounted on a jib which is mounted for pivotal movement in a vertical plane on a carrier which is movable along the rack.

13. An installation according to claim 1, wherein the plough drive chain is joined to the plough at about its middle.

14. In a mineral mining installation comprising a conveyor, a main winning machine movable along a main guide provided at the face side of the conveyor, and an auxiliary winning machine for winning material from the "stable-hole" at one end of the conveyor, the auxiliary winning machine being movable along an auxiliary guide, the improvements comprising constituting the auxiliary winning machine by a cutter drum mounted on a carrier by means of a jib, providing the carrier with a drivable pinion which drivingly engages a rack provided on the auxiliary guide for driving the auxiliary winning machine along the auxiliary guide, the main winning machine comprising a plough which is driven by an endless chain passing round two sprockets at the ends of the conveyor, and the auxiliary guide extending beyond the end sprockets at said one end.

* * * * *